US011155098B2

(12) United States Patent
Swier et al.

(10) Patent No.: US 11,155,098 B2
(45) Date of Patent: Oct. 26, 2021

(54) NEGATIVE PRESSURE APPLICATION TO A GAS-FILLED VOLUME

(71) Applicant: HEWLETT-PACKARD DEVELOPMENT COMPANY, L.P., Spring, TX (US)

(72) Inventors: Kevin E. Swier, Albany, OR (US); David R Otis, Jr., Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 70 days.

(21) Appl. No.: 16/580,979

(22) Filed: Sep. 24, 2019

(65) Prior Publication Data

US 2020/0016902 A1 Jan. 16, 2020

Related U.S. Application Data

(62) Division of application No. 15/543,365, filed as application No. PCT/US2015/013462 on Jan. 29, 2015, now Pat. No. 10,449,777.

(51) Int. Cl.
*B41J 2/19* (2006.01)
*B41J 2/175* (2006.01)

(52) U.S. Cl.
CPC ..... *B41J 2/19* (2013.01); *B41J 2/175* (2013.01); *B41J 2/17506* (2013.01); *B41J 2/17556* (2013.01)

(58) Field of Classification Search
CPC .... B41J 2/17556; B41J 2/175; B41J 2/17553; B41J 2/17503; B41J 2/19; B41J 2/17506
See application file for complete search history.

(56) References Cited

U.S. PATENT DOCUMENTS

| | | | |
|---|---|---|---|
| 6,652,080 | B2 | 11/2003 | Childs et al. |
| 6,682,165 | B2 | 1/2004 | Yearout |
| 7,195,333 | B2 | 3/2007 | Huliba |
| 7,682,008 | B2 | 3/2010 | Platt et al. |
| 8,007,068 | B2 | 8/2011 | Esdaile-Watts et al. |
| 8,042,902 | B2 | 10/2011 | Katada |
| 8,240,822 | B2 | 8/2012 | Yokouchi et al. |
| 8,256,871 | B2 | 9/2012 | Platt |
| 8,820,904 | B2 | 9/2014 | Aldrich et al. |
| 2002/0063759 | A1 | 5/2002 | Hirano et al. |

(Continued)

FOREIGN PATENT DOCUMENTS

| | | |
|---|---|---|
| CN | 1371808 | 10/2002 |
| CN | 102529386 | 7/2012 |

(Continued)

OTHER PUBLICATIONS www.pall.co.in—"Selection Guide for Ink Jet Ink Formulation", Web page, http://www.pall.co.in/main/graphic-arts/selection-guide-for-ink-jet-ink-formulat-54926.page >, Pall Corporation, Retrieved Nov. 21, 2017, 6 pages.

(Continued)

*Primary Examiner* — Jannelle M Lebron
(74) *Attorney, Agent, or Firm* — Trop Pruner & Hu PC

(57) ABSTRACT

In some examples, a method includes applying a negative pressure to a gas-filled volume through a vent. While a pressure in the volume decreases, the method draws a gas out through the vent and moves a liquid into the volume. The volume is filled with the liquid so that one side of the vent is covered with the liquid and the pressure in the volume increases up to a specified point.

21 Claims, 10 Drawing Sheets

(56) References Cited

U.S. PATENT DOCUMENTS

| | | | |
|---|---|---|---|
| 2005/0243147 | A1 | 11/2005 | Qingguo et al. |
| 2010/0182387 | A1 | 7/2010 | Silverbrook et al. |
| 2013/0233418 | A1 | 9/2013 | Aldrich et al. |
| 2013/0255826 | A1 | 10/2013 | Qing et al. |
| 2014/0043381 | A1 | 2/2014 | Izawa et al. |

FOREIGN PATENT DOCUMENTS

| | | |
|---|---|---|
| CN | 103568561 | 2/2014 |
| EP | 0002591 | 6/1979 |
| EP | 1080918 | 5/2004 |
| EP | 1057644 | 6/2010 |
| EP | 2657033 | 10/2013 |
| JP | 2014024320 | 2/2014 |
| WO | WO-2006093470 | 9/2006 |
| WO | WO-2012024125 | 2/2012 |
| WO | WO-2014009233 | 1/2014 |

OTHER PUBLICATIONS www.spotidoc.com—"PrintMaster Rubens User Manual Multi-Purpose Dgital Fatbed Pinter", Retrieved from Internet (http://spotidoc.com/doc/302905/printmaster-rubens-user-manual), Dec. 6, 2017, 2 pages.

NEGATIVE PRESSURE APPLICATION TO A GAS-FILLED VOLUME

CROSS REFERENCE TO RELATED APPLICATIONS

This is a divisional of U.S. application Ser. No. 15/543,365, having a national entry date of Jul. 13, 2017, which is a national stage application under 35 U.S.C. § 371 of PCT/US2015/013462, filed Jan. 29, 2015, which are both hereby incorporated by reference in their entirety.

BACKGROUND

Some printers occasionally ingest air either through printhead nozzles or through an ink supply inlet. Especially during shipment, when vibrations occur, or where printers are placed on the side, air ingestion may be hard to prevent. Also, once air is ingested it may be difficult to get the air out of the system. Certain measures can be taken to counter ingestion of air, such as filling printheads with shipment fluids for transport.

BRIEF DESCRIPTION OF THE DRAWINGS

For the purpose of illustration, certain examples constructed in accordance with this disclosure will now be described with reference to the accompanying drawings.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

In this disclosure example printbar assemblies are described. The printbar, when installed, may be part of any high precision liquid dispense system, for example of a two dimensional or three dimensional print system. The printbar can be suitable for printing liquid over an entire media width, for example an entire page width or 3D powder printing platform width. Suitable print liquids include liquids such as ink and three dimensional printing agents or inhibitors. In different examples, the printbar can have nozzle arrays of at least approximately 300, 600, 900 or 1200 nozzles per inch over at least an A4 or US letter page width. In this description, "downstream" and "upstream" relate to a path of liquid flow, unless mentioned otherwise.

Certain page wide printbar assemblies are filled with a shipping liquid for shipment. While the shipping liquid keeps air out of the printbar assembly, there may be a risk that shipping liquid leaks out of the printbar assembly.

Typically, after ink supplies are connected and the printer is switched on, a startup routine is automatically initiated. In the startup routine, the shipping fluid is flushed out and replaced with liquid from the liquid supply. Some printbars have internal liquid volumes of more than 20 or more than 40 cubic centimeters per ink color so that the flushing can take several minutes to complete. Typically, the flushed liquid is absorbed by a waste liquid absorbing medium. Flushing large amounts of liquid may lead to early saturation of the absorbing medium and/or may increase a size and costs of the absorbing medium.

Figure 1:
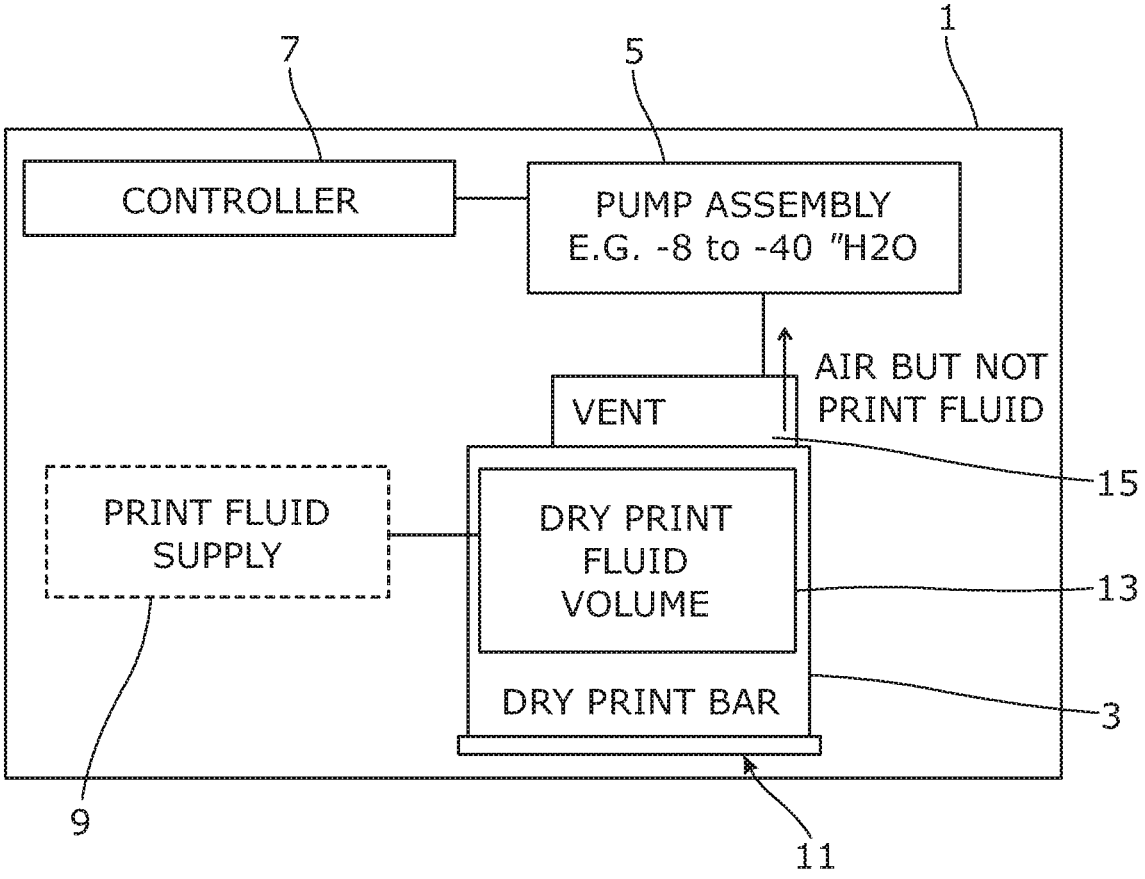
FIG. 1 illustrates a diagram of an example print system.

FIG. 1 illustrates a print system 1. The print system 1 can be any high precision digital dispensing device such as a 2D or 3D printer. The print system 1 includes a printbar assembly 3. In certain examples, the printbar assembly 3 is manufactured and assembled as a separate subassembly, before mounting to the print system 1. In this example, the print system is unused. Before usage, the printbar assembly 3 is substantially void of print liquid. Instead of liquid, a gas such as air occupies most or all of the print bar assembly's inner volumes.

The print system 1 includes a pump assembly 5 that is to apply a negative pressure to the printbar assembly 3. The pump assembly 5 will hereinafter be referred to as negative pressure pump assembly 5, although in certain examples it may also be suitable to apply a positive pressure. The print system 1 also includes a controller 7 to control functions of the print system 1. The controller 7 is to instruct the negative pressure pump assembly 5. The print system 1 is to receive a liquid supply 9 to fluidically interconnect with the printbar assembly 3. The liquid supply 9 may be a disposable and/or replaceable print liquid cartridge, or a continuous liquid supply system.

The printbar assembly 3 includes at least one nozzle array 11 to dispense the liquid, in the drawing represented by a diagrammatically drawn nozzle plate. The printbar assembly 3 further includes at least one volume 13 between the liquid supply 9 and the nozzles 11. The volume 13 retains and guides liquid from the supply 9 to the nozzles 11. The volume 13 may include at least chamber or a series of chambers and liquid channels upstream and downstream of such chamber.

An air vent 15 is provided in a wall of the volume 13. The vent is a membrane or mesh-type structure that blocks liquid and allows air to pass through, at least in an operational pressure range of the negative pressure pump assembly 5. The vent 15 is mounted to a wall of the volume 13 to contact air and liquid that may be present in the volume 13. In an example, the volume 13 is located directly adjacent to the vent 15. The vent 15 is connected to the pump assembly 5. The vent 15 blocks liquid. The printbar assembly 3 may include further intermediate fluid channeling components such a manifold and filters inside the channels and volumes. In one example a filter is provided between the volume 13 and the nozzle array 11 to filter debris from the print liquid.

In this example, the printbar assembly 3 is unused. For example, the printbar assembly 3 printed any end user print job and has yet to initiate a startup routine. The volume 13 of the printbar assembly 3 is substantially void of print liquid and shipping fluid. That said, certain components of the printbar assembly 3 such as vents 15, filters and/or nozzles 11 may be wetted for purposes explained later in this disclosure but other than that gas occupies the internal volume 13 of the printbar assembly 3. In an example, "substantially void of liquid" or "gas-filled" can be understood as having less than 15%, less than 10%, or less than 7% of liquid (e.g. print liquid or shipping fluid). Correspondingly at least 85%, at least 90% or at least 93% of the inner channels of the printbar assembly 3 is filled with air or another gas. In one example, the internal volume 13 of the printbar assembly 3 is at least approximately 20 cubic centimeters, or at least approximately 40 cubic centimeters. In an example the printbar assembly 3 is provided with a plurality of volumes 13 and nozzle arrays 11 to print a plurality of distinct liquids. Each volume 13 may consist of a plurality of interconnected channels and chambers leading up to the nozzle array 11.

After connecting the print liquid supply 9, the print system 1 may initiate a startup routine. The startup routine may be activated automatically by turning on the print system 1 or may need an additional manual selection to be activated, for example through an operator panel.

Once the print system 1 is activated, the controller 7 instructs the pump assembly 5 to apply a negative pressure, and to maintain the pressure at an appropriate level during a relatively long accumulated time span. The relatively long accumulated time span is needed to evacuate the air out of the volume 13. With "relatively" long accumulated time span it is meant that the accumulated time span of actively applying negative pressure during startup is longer than the accumulated time span after startup, during normal usage, measured on average over a given time period (e.g. 1 minute). The relatively long accumulated time span can be achieved by refreshing the negative pressure at a relatively high frequency and/or by actively applying the negative pressure during relatively long time periods. During startup, the pump assembly 5 may relatively continuously suck air out of the printbar 3, or switch a negative pressure pump (or valve) on and off at a high frequency so that the accumulated time span during startup is relatively long. During startup, at least approximately 20 cubic centimeters of air may be displaced out of the printbar assembly 3, through the vent 15, in less than 2 minutes. For example the internal liquid volume 13 of the printbar assembly, i.e. the volume that is to hold liquid of one type between the supply 9 and the nozzles 11, is at least approximately 20 cc or at least approximately 40 cc.

The vacuum created in the volume 13 by the negative pressure pump assembly 5 may pull in liquid from the liquid supply 9. Hence, during startup all air in the volume 13 can be replaced by liquid. At the end of the startup routine, the volume 13 of the printbar assembly 3 is filled with print liquid. The print liquid covers one side of the vent 15, while the vent 15 is dry on the other side.

After completing the startup routine, the controller 7 instructs the pump assembly 5 to refresh the negative pressure during a relatively shorter accumulated time spans, i.e. shorter accumulated time spans (over a certain predetermined time period) than during startup. A short accumulated time span is sufficient to evacuate occasional air bubbles that may enter the volume 13 during routine usage. The pump assembly 5 may turn on the negative pressure less frequently than during startup, and/or apply shorter time periods of negative pressure. Since the printbar assembly 3 is filled with print liquid already, less air needs to be removed. For example, after the startup routine, during routine usage of the print system, less than approximately 4 cubic centimeters of air, or less than approximately 2 cubic centimeters of accumulated air bubbles is displaced out of the printbar assembly 3 through the vent 15, in one month, based on usage rates of between approximately 20 and 150 cubic centimeters per months.

Hence, the disclosed example printbar 3 may shipped dry, reducing a risk of leaking fluids. In turn, less print or ship fluid needs to be flushed at startup so that saturated ink absorption members can be avoided. A startup routine of the print system 1, during which the entire volume 13 filled may take less than 2 minutes, less than 110 seconds, less than 90 seconds or for example less than 1 minute to complete.

Figure 2:
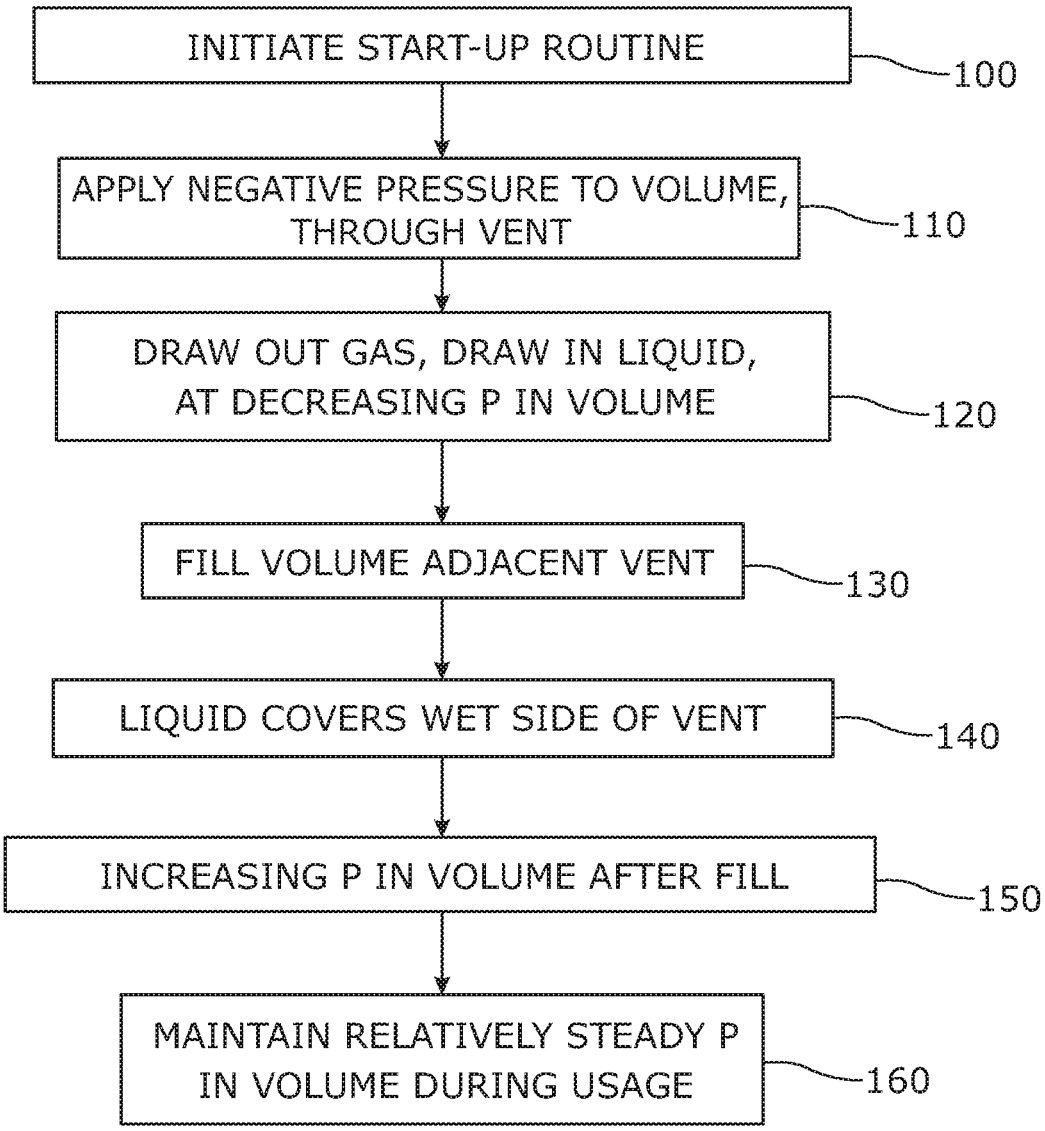
FIG. 2 illustrates a flow chart of an example of starting and using a print system.

FIG. 2 illustrates an example of a method of starting a print system. The method includes initiating a startup routine of the print system (block 100). The method includes applying a negative pressure to a gas-filled volume through a vent in a substantially dry printbar (block 110). The method includes, while the pressure in the volume decreases (i.e. negative pressure builds up) drawing out gas from the first volume through the vent and drawing in liquid from the supply (block 120). The method includes filling the volume adjacent the vent with print liquid (block 130). The method includes filling the volume so that the print liquid substantially completely covers a wet side of the vent (block 140), resulting in an increasing pressure (i.e. decreasing negative pressure) in the volume (block 150), at the end of the startup routine. In one example of the method, the pressure in the volume is maintained relatively steady after completion of the startup routine, during usage (block 160).

Figure 3:
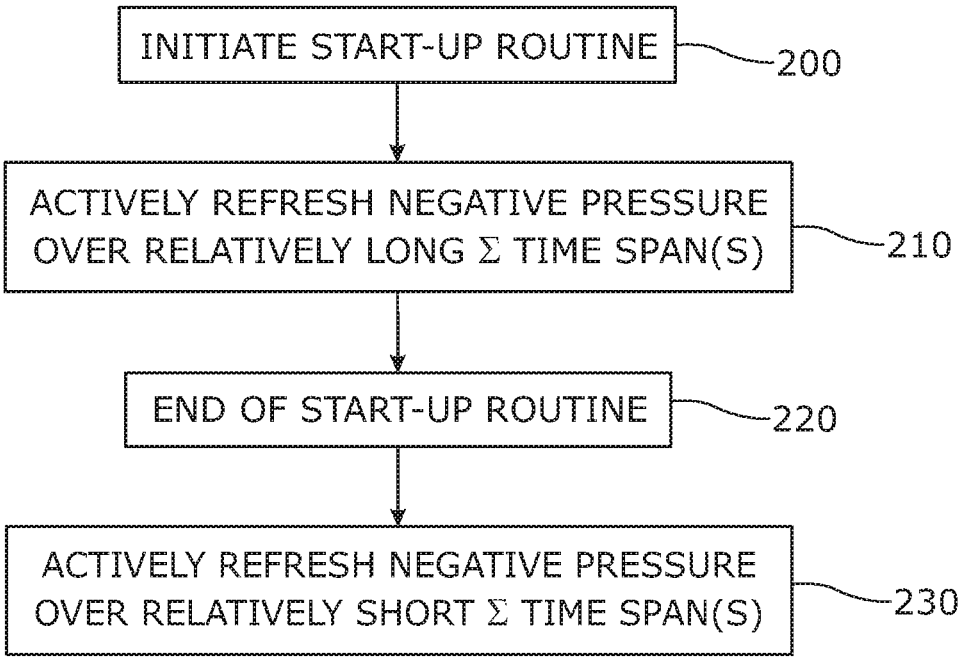
FIG. 3 illustrates a flow chart of another example start up routine.

FIG. 3 illustrates another example of starting a print system 1. The method includes initiating a startup routine (block 200). The method includes actively refreshing a negative pressure over a relatively long accumulated time span (block 210). A relatively long accumulated time span can be understood as applying relatively long negative pressure cycles and/or applying negative pressure cycles relatively frequently. For example, at least approximately 20 cubic centimeters of air can be displaced out of the printbar assembly through the vent in less than 2 minutes. The method includes ending the startup routine (block 220), for example when the internal printbar channels and volumes are substantially filled. The method includes actively refreshing the negative pressure over relatively short accumulated time spans (block 230). A relatively short accumulated time span can be understood as applying shorter and/or less frequent negative pressure cycles, i.e. shorter accumulated time spans (over a certain predetermined time period) than during startup. This is because less gas needs to be evacuated after startup. For example, after the startup routine, during routine usage of the print system, less than approximately 4 cubic centimeters of air, or less than approximately 2 cubic centimeters of accumulated air bubbles is displaced out of the printbar assembly through the vent per month, based on usage rates of between approximately 20 and 150 cubic centimeters per months.

Figure 4:
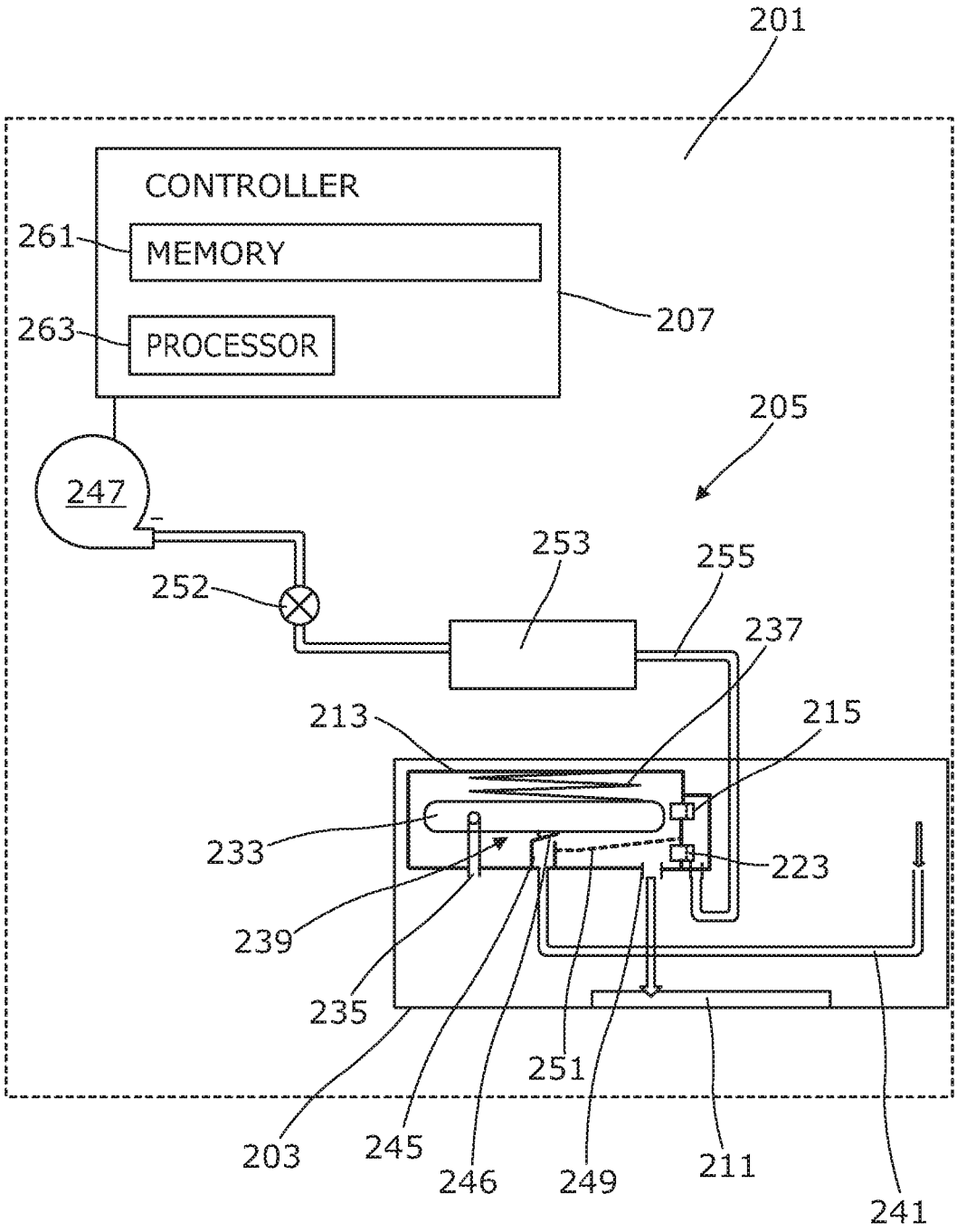
FIG. 4 illustrates a diagram of an example print system.

FIG. 4 illustrates an example of a print system 201 including a printbar assembly 203 and a negative pressure pump assembly 205. The printbar assembly 203 includes a series of volumes such as channels and chambers to hold liquid and guide liquid to the nozzles. Before startup, these channels and volumes are filled with air. In the illustrated example, the printbar 203 includes a liquid volume 213 to hold liquid. In this example, the volume 213 is a regulator chamber. A pressure regulator assembly 239 is disposed inside the liquid volume 213. The regulator assembly 239 includes an air bag 233 of a flexible film material, wherein the inside of the air bag 233 is fluidically connected to an air interface 235. The air interface 235 may interface with ambient air or with a pump, for example through a labyrinth. The air bag 233 is to collapse and expand to maintain a desired pressure in the liquid chamber 205. The regulator assembly 239 includes a spring 237 that exerts enough pressure to the bag 233 to provide for a backpressure in the liquid volume 213 and thereby oppose to liquid drooling out of the nozzles 211 (in the drawing represented by a diagrammatically drawn nozzle plate).

The liquid volume 213 includes a liquid inlet 245 and a valve 246. The valve 246 either seals or opens the inlet 245. The liquid inlet 245 is connected to a liquid supply channel 241 that during usage is connected to a liquid supply. Flexing of the bag 233 actuates the valve 246 to open or close. In an example, expansion of the bag 233 actuates the valve 246 to open the inlet 245 to allow liquid to flow in, and collapsing the bag 233 actuates the valve 246 to close the inlet 245. Different example mechanical connections can be applied to achieve opening of the valve at expansion and closing at collapse, such as a lever and fulcrum.

The liquid volume 213 includes a liquid outlet 249 to supply liquid to the nozzles 211 of the printbar assembly 203. The printbar assembly 203 includes a liquid filter 251 upstream of the outlet 249 to filter undesired particles that may be present in the liquid. In one example the outlet 249 provides liquid to a manifold that channels the liquid to respective nozzles 211.

The printbar 203 includes a first vent 215 upstream of the liquid filter 251 to vent air upstream of the liquid filter 251 out of the liquid volume 213. The printbar assembly 203 includes a second vent 223 downstream of the liquid filter 251 to vent air downstream of the liquid filter 251, for example from a manifold. The vents 215, 223 each include at least one air filtering membrane that is air permeable and liquid impermeable, in a direction out of the liquid volume 213, in an operational pressure range of the negative pressure pump assembly 205.

The vents 215, 223 are connected to the negative pressure pump assembly 205, for example through a common vent interface and an air guide 255. The negative pressure pump assembly 205 includes a negative pressure source such as a pump 247. The pump 247 may be a positive and negative pressure pump but for the purpose of the startup routine will apply a negative pressure to the vents 215, 223, and hence the assembly 205 is herein referred to as negative pressure pump assembly 205. The pump 247 is connected to the vents 215, 223 through an air guide 255. In this example, a solenoid valve 252 and a vacuum reservoir 253 are connected to the air guide 255 between the pump 249 and the vents 215, 223. The pump 247 establishes and refreshes a negative pressure in the vacuum reservoir 253. For example, during normal usage, the pump 247 is activated at a predetermined frequency to refresh the negative pressure in the vacuum reservoir 253. For example, during startup the pump 247 is activated at a high frequency and/or during at least one longer time span as compared to normal usage post-startup.

The solenoid valve 252 can be controlled (by a controller 207) to allow air flow between the pump 247 and the vacuum reservoir 253, thereby controlling the refresh cycle of the vacuum reservoir 253. In the illustrated example, the negative pressure in the vacuum reservoir 253 can be regulated by controlling both the solenoid valve 252 and the pump 247 or by controlling only the solenoid valve 252 while the pump cycle frequency remains constant. The vacuum reservoir 253 applies a suction force to the vents 215, 223 that has enough impetus for air to pass out of the printbar assembly 203 through the vents 215, 223.

The print system 201 includes a print system controller 207 to instruct the negative pressure pump assembly 205 to impose a negative pressure on the vents 215, 223. The controller 207 includes a digital memory 261 that stores instructions. The controller 207 includes a processor 263 to signal the negative pressure pump assembly 205 based on the instructions. The digital memory 261 can be a non-volatile, non-transient memory. The controller 207 can include an application specific integrated circuit (ASIC). The controller 207 can include a digital and analogue ASIC. The controller 207 may regulate the negative pressure in the vacuum reservoir 253 to maintain the negative pressure within a desired pressure range. The controller 207 may instruct the pump 247, the solenoid valve 252 or both.

At startup, the controller 207 may instruct the negative pressure pump assembly 205 to refresh the negative pressure in the vacuum reservoir 253 relatively continuously, to evacuate a relatively large amount of air in a relatively short amount of time. A long accumulated time span can be achieved up by opening the solenoid valve 252 at high frequency and/or during relatively long time periods. At the end of the startup routine substantially all air in the volumes and channels in the printbar assembly 3 has been replaced with print liquid.

After the startup routine, the controller 207 instructs the pump assembly 205 to refresh the negative pressure during a shorter accumulated time spans over given time periods. The controller 207 may open the solenoid valve 252 less frequently and/or during shorter time periods than during startup, sufficient to draw out air bubbles that may enter the printbar assembly 3 through the nozzles 211.

Figure 5:
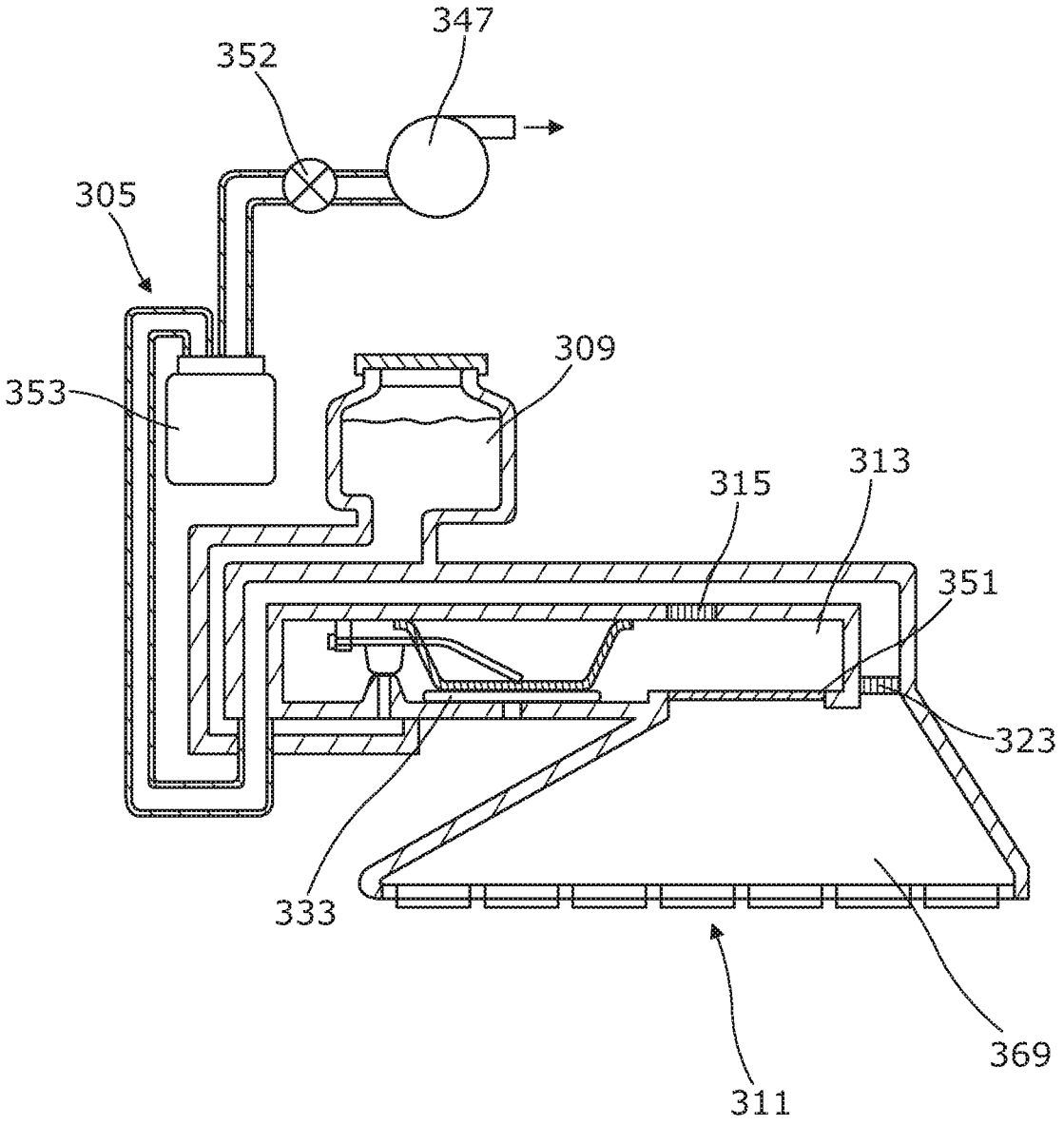
FIG. 5 illustrates a diagram of another example print system in a first stage.
Figure 6:
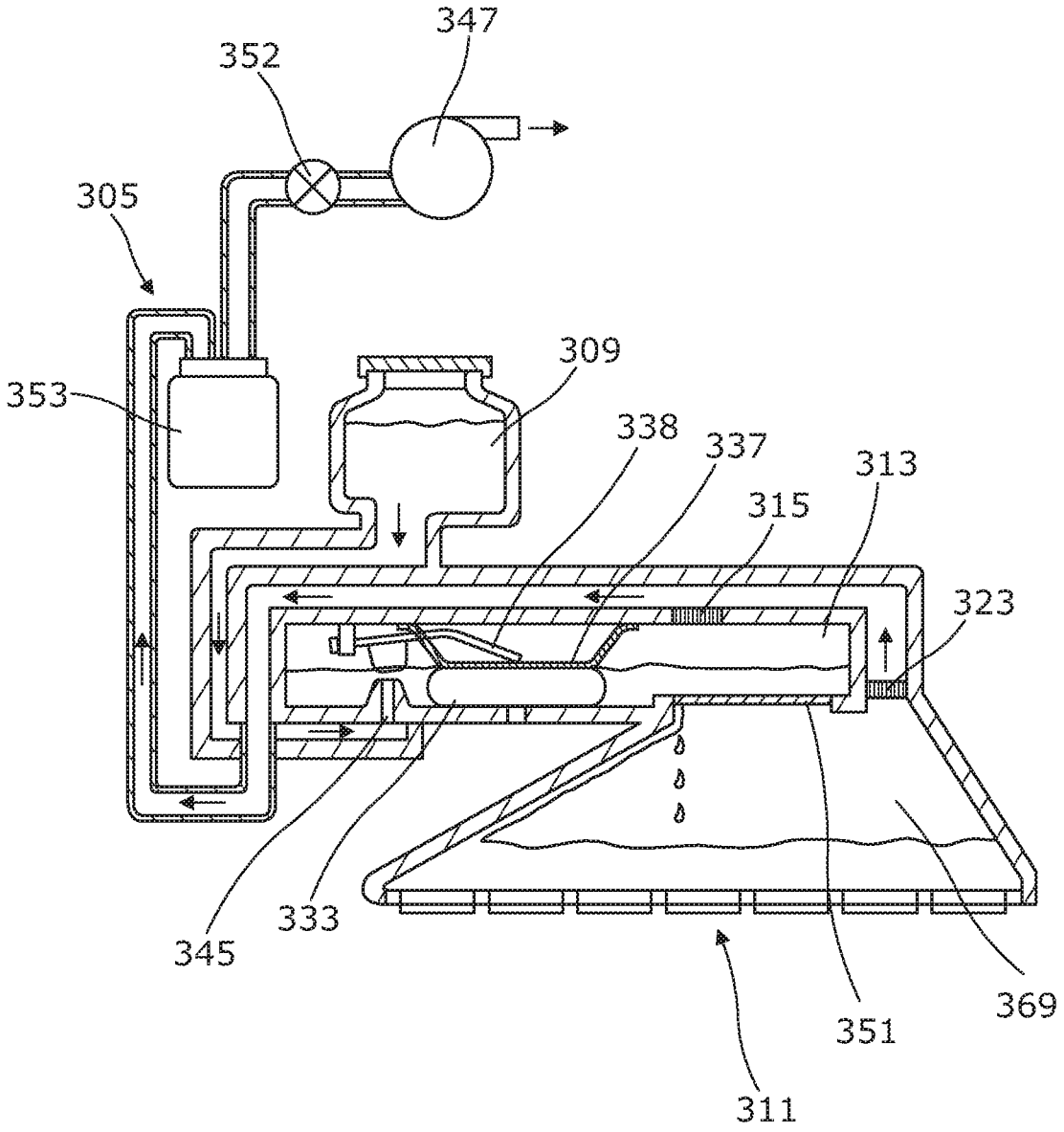
FIG. 6 illustrates a diagram of the example print system of FIG. 5 in a second stage.
Figure 7:
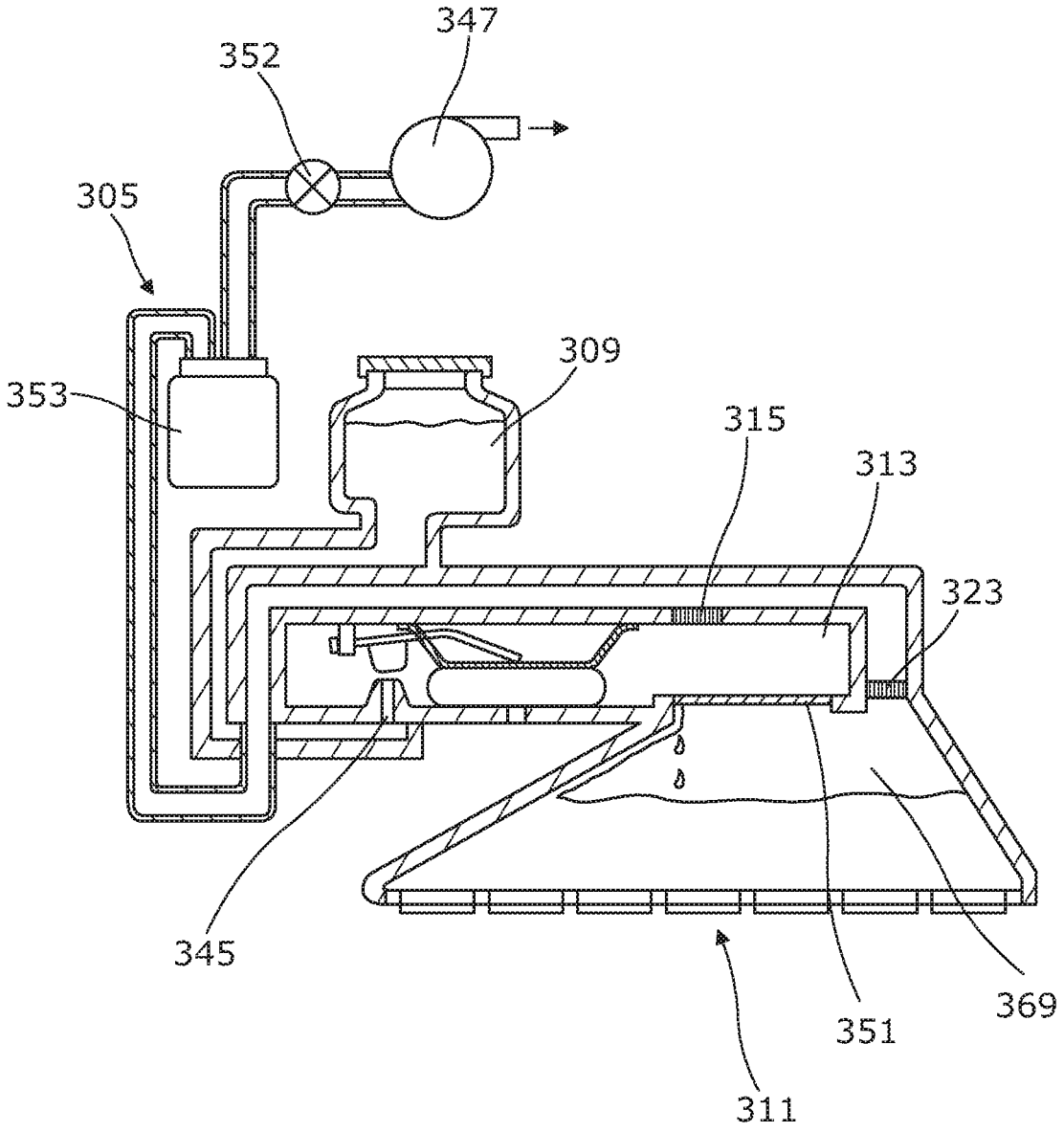
FIG. 7 illustrates a diagram of the example print system of FIGS. 5 and 6 in a third stage.

FIGS. 5-7 illustrate a negative pressure pump assembly 305, and a printbar assembly 303 in different stages during a startup routine. FIG. 5 illustrates the printbar assembly 303 in an empty, air-filled stage, before any liquid has entered the printbar assembly 303. In the stage of FIG. 5 an ink supply 309 has already been connected to the printbar assembly 303. The printbar assembly 303 includes a regulator volume 313 that is connected to a first vent 315, a manifold volume 369 that is connected to a second vent 323, a filter 351 between the regulator volume 313 and the manifold volume 369, and a nozzle array 311 at the end of the liquid stream.

The pump assembly 305 includes a pump 347, a solenoid valve 352 and a vacuum reservoir 353. For example, in the stage illustrated in FIG. 5 the negative pressure pump assembly 305 has just started applying a negative pressure and is still building up pressure in the vacuum reservoir 353, for example so as to reach approximately −20 " H2O (inches water column). The bag 333 has not yet inflated and liquid in the supply 309 has not yet entered the regulator volume 313. In one example, the vents 315, 323, filter 351 and nozzles 311 have been pre-wetted, wherein the wet film acts may act as a barrier, at least in a pressure range that is lower than the negative working pressure of the negative pressure pump assembly 305. In the example of FIG. 5 the pressure gradient has not yet reached the level necessary to allow air to pass through the wet vent 315 towards the pump 347. In different examples, the minimum pressure gradient needed for air to pass through the wetted vent 315, 323 (i.e. the vent's "bubble pressure") is between approximately 5 and approximately 15 " H2O, for example between 8 and approximately 12 " H2O.

FIG. 6 illustrates a stage of the printbar assembly 303 wherein the pressure difference between the negative pressure pump assembly 305 and the regulator volume 313 is higher than the bubble pressure of the wetted first vent 315. Hence, air is being pulled through the vents 315, 323 into the negative pressure pump 305 assembly. In reaction to air flowing out of the first vent 315, the bag 333 expands against the force of a spring 337 so that a fulcrum 338 opens the liquid inlet 345, allowing the liquid to flow into the regulator volume 313. In this example, the negative pressure that is created draws in the liquid. In another example, a liquid pump can pump liquid into the regulator volume 313. In yet another example, a combination of negative pressure and liquid pumping may be applied to move to the liquid. As the liquid fills the regulator volume 313 it covers the filter 351 downstream of the regulator volume 313. As air is drawn in through the second vent 323, a negative pressure is also built up in the manifold volume 369 that causes some of the liquid in the regulator volume 313 to flow through the filter 351 into the manifold volume 369.

FIG. 7 illustrates a stage of the printbar assembly 303 where the regulator volume 313 is filled with liquid. All air has been drawn out of the regulator volume 313 through the first vent 315. Print liquid has filled the regulator volume 313 and covers the first vent 315. At this point, no further air passes through the first vent 315. Air still fills a portion of the manifold volume 369. The remainder air is pulled out through the second vent 323 until also the manifold volume 369 is filled with liquid.

In one example the nozzles are pre-wetted, and the negative pressure pump assembly applies a negative pressure that, on the one hand, is enough to overcome the wetted bubble pressure of the vents, and on the other hand, does not exceed a wetted bubble pressure of the nozzles to avoid pulling air in through the nozzles. For example, during the startup routine the negative pressure of the negative pressure pump assembly is between approximately −6 and approximately −40 " H2O, or between approximately 12 and 40 " H2O.

Figure 8:
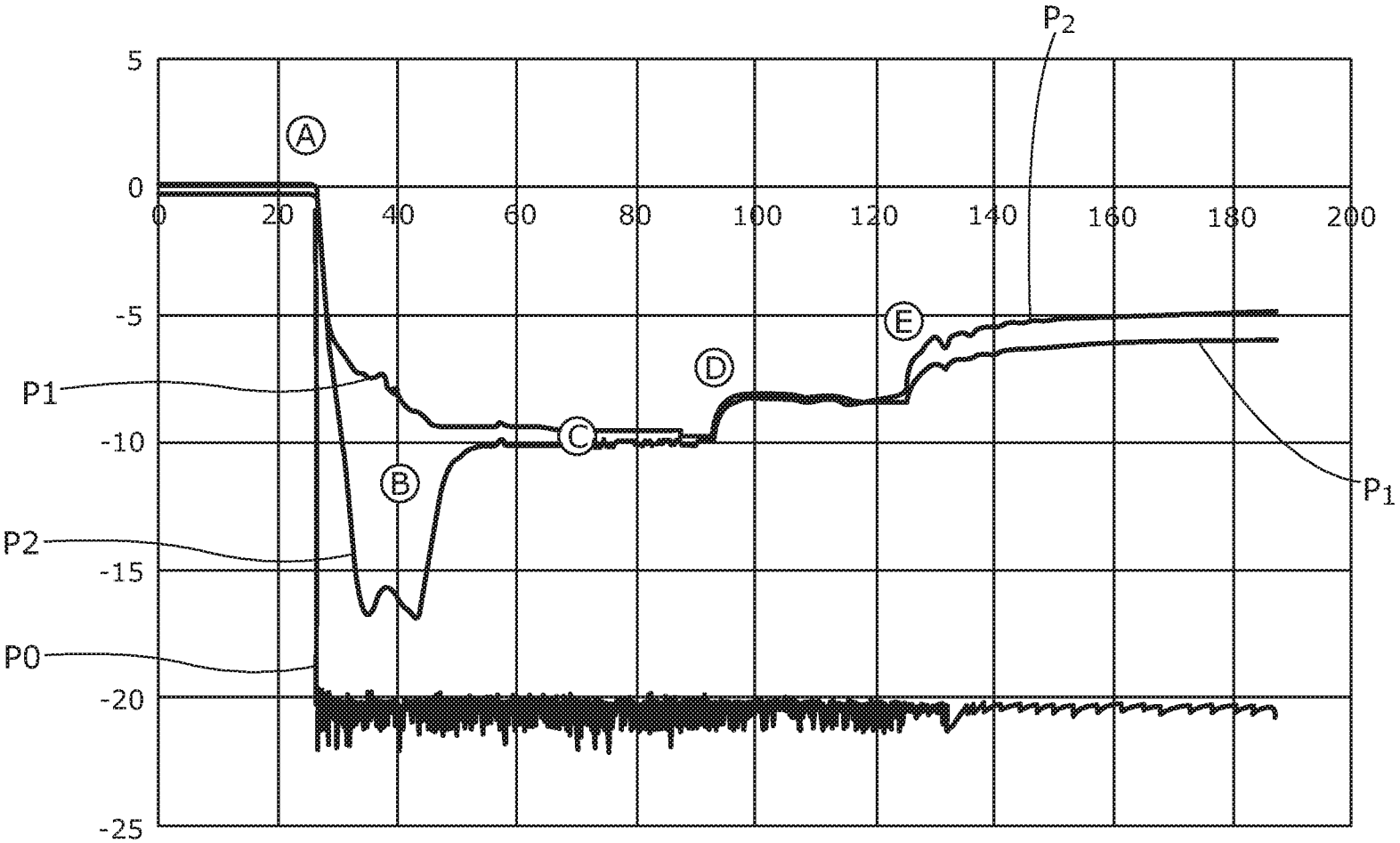
FIG. 8 illustrates a graph of example pressures in a printbar assembly and a vacuum reservoir during a startup routine.

In one example, the total volume of interconnected fluid channels and volumes for one liquid type (e.g. ink color) in the printbar assembly is at least approximately 15 cubic centimeters, at least approximately 20 cubic centimeters, at least approximately 30 cubic centimeters, or at least approximately 40 cubic centimeters. Hence, during the startup routine at least 15, 20, 30 or 40 cubic centimeters of air is displaced out of the printbar assembly and at least 15, 20, 30 or 40 cubic centimeters of liquid is displaced into the printbar assembly. The startup routine takes less than approximately 2 minutes to complete, for example less than approximately 110 seconds, less than 90 seconds, or less than a minute. After the startup routine, during routine print system usage, for example less than approximately 4 or less than approximately 2 cubic centimeters of air bubbles needs to be displaced per month, based on usage rates of between approximately 20 and 150 cubic centimeters per months FIG. 8 illustrates an example graph that projects a first pressure P1 in a regulator volume, a second pressure P2 in a manifold volume and a third pressure P3 in a vacuum reservoir of a negative pressure pump assembly. The pressure is set on the vertical axis in " H2O. The time is set on the horizontal axis in seconds. The examples of FIG. 5-7 may serve to better understand the graph. Points in time A, B, C, D and E will be discussed in chronological order.

At a first point in time A a negative pressure P3 is applied to the vents by a vacuum reservoir of a negative pressure pump assembly. The negative pressure P3 of the vacuum reservoir may be refreshed at a high frequency, to maintain a relatively constant pressure level, in the illustrated example at approximately −20 " H2O. As a result, the first and second pressures P1, P2 decline.

The declining first pressure P1 causes the regulator bag to expand, which in turn moderates the decline of the first pressure P1 in the regulator volume. As can be seen at a second point in time B, the first pressure P1 decreases more slowly than the second pressure P2. At point in time B, a wetted filter between the regulator volume and the manifold volume may inhibit equalization of the first and pressure P1, P2, which causes an increasing pressure difference, until the liquid breaks through the liquid seal of the filter, after which the second pressure P2 increases again. While the regulator volume is filled with liquid and the bag in the regulator volume stops expanding, the pressures P1, P2 in the regulator volume and the manifold volume may tend towards a more equalized pressure level, near a third point in time C. At a fourth point in time D the regulator volume has been completely filled with liquid and the regulator has flattened. The liquid seals one side of the first vent so that the first vent stops drawing air and only the second vent draws air. This causes an increase in the pressures P1, P2 of the regulator and manifold volume. At a fifth point in time E, also the manifold volume is filled with liquid so that liquid also covers the second vent, causing again an increase in the pressures P1, P2 of both volumes. In the illustrated example, after point E the second pressure P2 is higher than the first pressure due to hydrostatic head effects.

At the fifth point in time E, the startup routine has completed and the volumes have been filled with liquid. From the fifth point in time E onwards, routine usage of the print system can be initiated, whereby the pressures P1, P2 in the printbar's internal volumes may be maintained relatively constant. The startup routine has started at the first point in time A and ended at the fifth point in time E, between which in the illustrated example approximately 100 seconds has passed. In other examples, the startup routine may take approximately 120 or less, approximately 110 seconds or less, approximately 95 seconds or less, or approximately 60 seconds or less.

Figure 9:
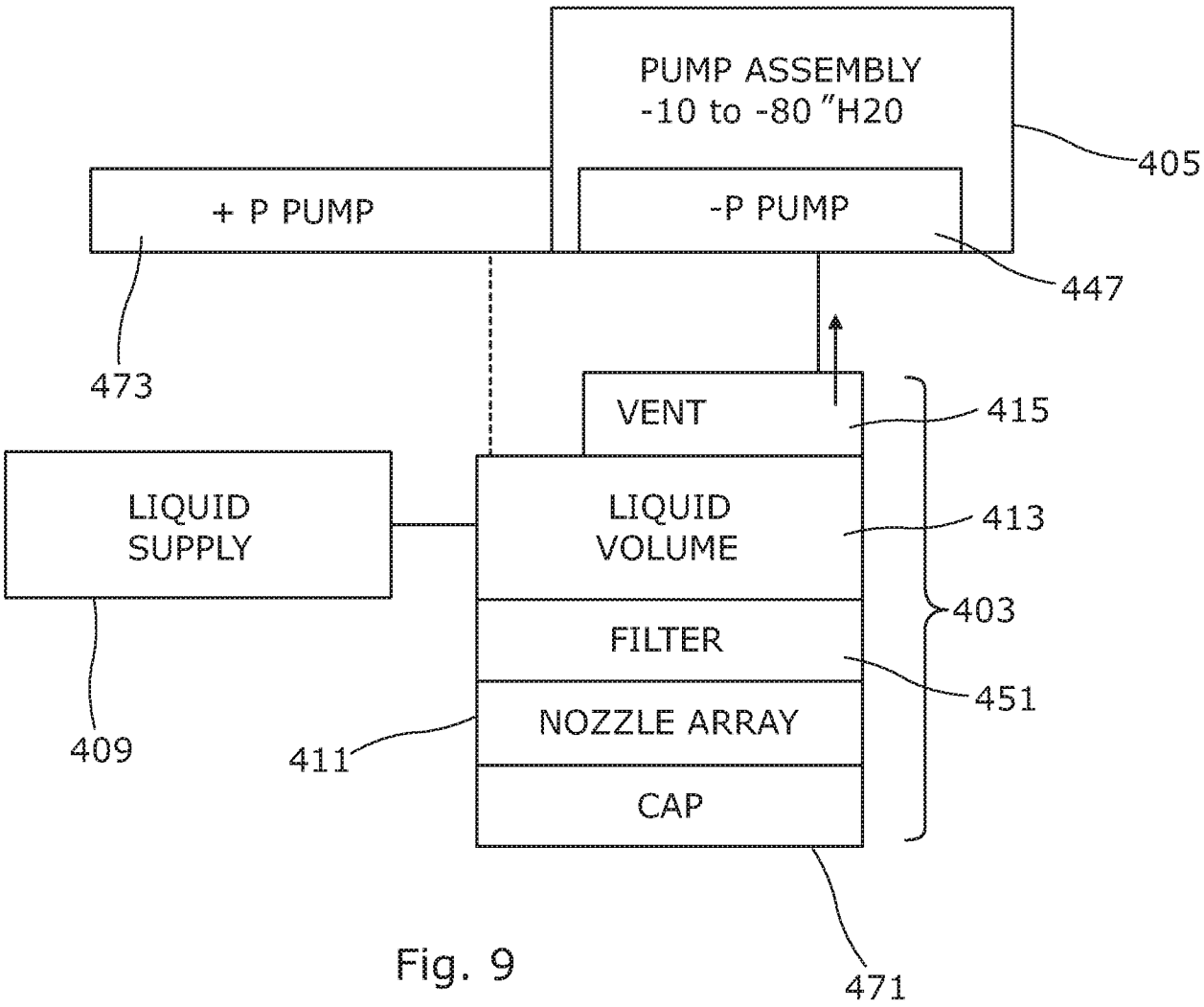
FIG. 9 illustrates an example print system.

FIG. 9 illustrates a diagram of another example of a printbar assembly 403 and a pump assembly 405 for in a print system. The printbar assembly 403 includes at least one liquid volume 413, a filter 451 within the liquid volume 413 and a nozzle array 411 downstream of the filter 451. The printbar assembly 403 further includes a vent 415 in the liquid volume 413 upstream of the filter 451. The vent 415 is air permeable and liquid impermeable in a direction out of the volume 413, at least within an operational pressure range of the negative pressure pump assembly 405. Before connecting a liquid supply 409 and initiating a startup routine, the printbar assembly 403 is filled with air. In one example, the vent 415 and filter 451 are pre-wetted. Other than that, the volume of the printbar assembly 403 is substantially completely filled with air. The vent 415 is connected to the negative pressure pump assembly 405 to draw air out of the liquid volume during startup.

In this example, there is no second vent downstream of the filter connected to the negative pressure pump assembly. Hence, during startup, air downstream of the filter needs to be pulled up through the first vent 415 through the filter 451. The negative pressure pump assembly 405 can be adapted to apply a negative pressure of between approximately −60 and −120 " H2O to, overcome the wetted filter's bubble pressure. The printbar assembly 403 may include a cap assembly 471 to cap the nozzles 411, at least during startup, to inhibit air being pulled into the nozzles as a result of the relatively high negative pressure. A positive pump 473 may be connected to the printbar assembly 403 to pump the liquid into the volume 413 to the nozzles 411.

Figure 10:
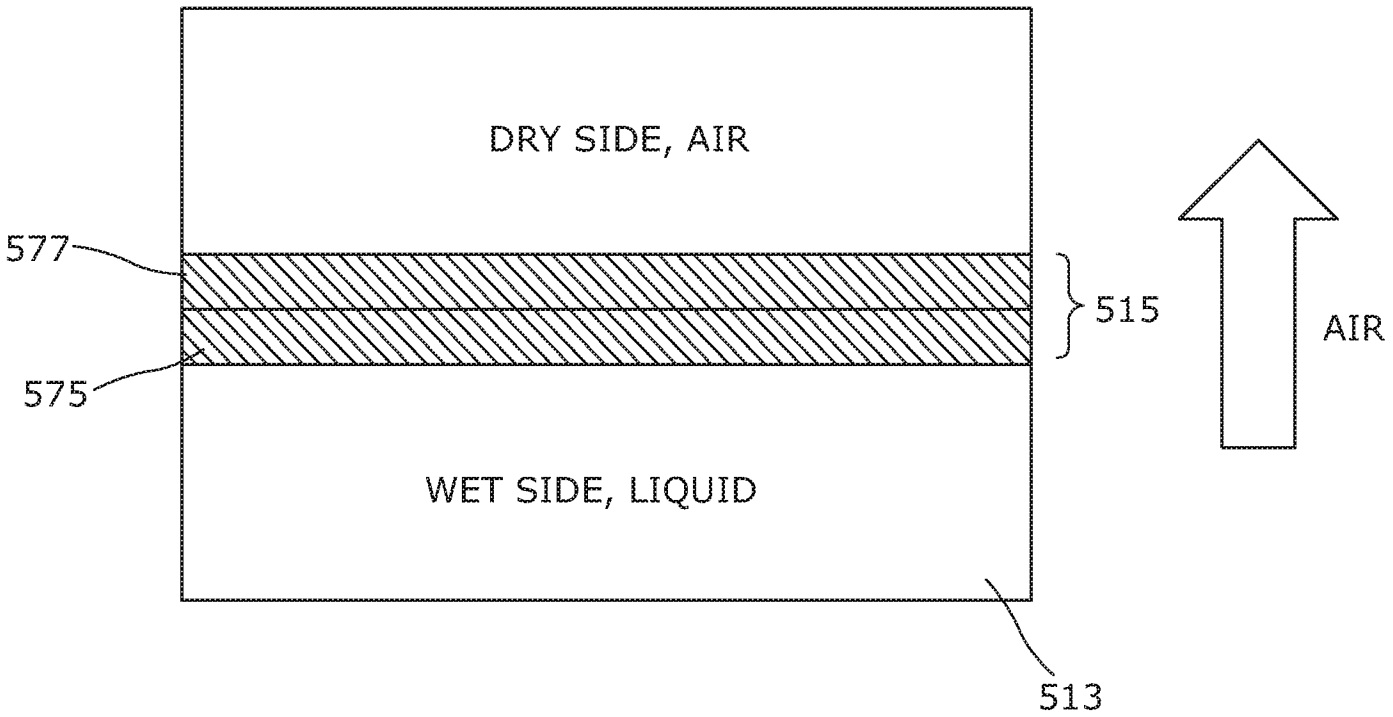
FIG. 10 illustrates an example vent.

FIG. 10 illustrates an example of a vent 515 that is air permeable and liquid impermeable, at least (i) when wetted, (ii) in an operational pressure range, and (iii) in a direction out of the fluid volume or channel. An operational pressure range refers to the negative pressure applied by the negative pressure pump assembly. The negative pressure pump assembly can be adapted to apply a negative pressure of between −6 to −120 " H2O, −6 and −40 " H2O, −12" H2O and −40 " H2O or between −60 and −120 " H2O. For example, during the startup routine, air will be drawn through the wetted vent starting at a pressure of approximately −6 " H2O or −12 " H2O while liquid will be drawn in through the vent when the negative pressure exceeds −120 " H2O. In the example of two vents as illustrated in FIGS. 4-7 an operational pressure range between −6 " H2O and −40 " H2O may be sufficient, or between approximately −12 " H2O and −40 " H2O. In the example of one vent upstream of the filter, a higher pressure range may be applied in order to pull bubbles through the filter in a capped condition of the nozzles, for example −60 to −120 " H2O.

In one example, the vent 515 includes a first liquid philic part 575 on a wet side, i.e. on the side of the liquid volume 513, and a second liquid phobic part 577 on the dry side, i.e. on the side of the negative pressure pump assembly. In the illustrated example, the parts 575, 577 are separate membranes. The parts 575, 577 may be in close contact. In certain examples, the parts 575, 577 may each include multiple layers, or both may be integrated into a single layer, for example with a gradient between the liquid philic and liquid phobic sides.

In certain examples of this disclosure, the pump of the negative pressure pump assembly may be a positive and negative pressure pump. With a suitable switch and valve arrangement such pump may be used in either a positive and negative pressure state depending on the liquid or air stream that it needs to pump for a given process. For example, such positive pressure can be applied to expand the bag or to pump the liquid into the printbar.

The invention claimed is:

1. A method of starting usage of a print system, comprising:

mounting an unused volume into the print system, wherein the unused volume is substantially void of a liquid prior to usage of the volume;

applying a negative pressure to the volume through a vent;

while a pressure in the volume decreases, drawing a gas out through the vent and moving a print liquid from a supply into the volume; and filling the volume with the print liquid so that one side of the vent is covered with the print liquid and the pressure in the volume increases up to a specified point.

2. The method of claim 1, wherein the vent is liquid impermeable and gas permeable in a direction out of the volume to allow gas but not liquid to be drawn out of the volume, when the vent is in a wet condition and within an operational pressure range applied to the vent in a range between −6 to −120 inches water column.

3. The method of claim 1, further comprising:

during startup of the print system, refreshing the negative pressure during a first accumulated time span; and after the startup that has filled the volume with the print liquid and during usage of the print system, refreshing a negative pressure during a second accumulated time span that is shorter than the first accumulated time span.

4. The method of claim 1, further comprising:

during startup of the print system, capping nozzles with a cap assembly or with a capping liquid.

5. The method of claim 1, wherein the volume is part of a printbar assembly that is substantially completely filled with air at startup of the print system, and by applying the negative pressure, at least 20 cubic centimeters of air is drawn out of the printbar assembly, through the vent, and replaced by the print liquid, within 2 minutes.

6. The method of claim 1, wherein the volume comprises a nozzle array.

7. The method of claim 1, wherein the volume comprises a filter, the vent is a first vent fluidically connected to the volume upstream of the filter, the method further comprising:

fluidically connecting a second vent to the volume downstream of the filter, wherein the negative pressure is applied through both the first and second vents.

8. The method of claim 7, wherein the negative pressure exceeds a wetted vent bubble pressure but does not exceed a wetted nozzle bubble pressure.

9. The method of claim 1, wherein the negative pressure is applied to the vent by a negative pressure pump assembly, the negative pressure applied to the vent exceeding a wetted vent bubble pressure of the vent.

10. The method of claim 1, wherein the negative pressure applied to the vent is applied by a vacuum reservoir in a negative pressure pump assembly.

11. The method of claim 10, wherein the negative pressure pump assembly includes a solenoid valve between a pump and the vacuum reservoir, the method further comprising:

instructing, by a controller, the solenoid valve to set negative pressure refresh cycles of the vacuum reservoir.

12. The method of claim 1, wherein the unused volume has less than 15% of the print liquid when the unused volume is initially mounted in the print system.

13. The method of claim 1, wherein the unused volume has less than 10% of the print liquid when the unused volume is initially mounted in the print system.

14. The method of claim 1, wherein the unused volume has less than 7% of the print liquid when the unused volume is initially mounted in the print system.

15. The method of claim 1, wherein the unused volume is part of a printbar that is shipped dry.

16. A method comprising:

receiving a print liquid ejection assembly comprising a nozzle array, wherein the print liquid ejection assembly is shipped dry in which a volume of the print liquid ejection assembly initially is substantially void of a liquid;

mounting the print liquid ejection assembly with the volume initially substantially void of a liquid into a print system;

after the mounting of the print liquid ejection assembly into the print system, applying a negative pressure through a vent to the volume that is initially substantially void of a liquid;

while a pressure in the volume decreases, drawing a gas out through the vent and moving a print liquid into the volume; and filling the volume with the print liquid so that one side of the vent is covered with the print liquid and the pressure in the volume increases up to a specified point.

17. The method of claim 16, further comprising:

during startup of the print system, refreshing the negative pressure during a first accumulated time span; and after the startup that has filled the volume with the print liquid and during usage of the print system, refreshing a negative pressure during a second accumulated time span that is shorter than the first accumulated time span.

18. The method of claim 17, further comprising:

during the startup of the print system, capping nozzles in the nozzle array with a cap assembly or with a capping liquid.

19. The method of claim 16, wherein the negative pressure exceeds a wetted vent bubble pressure but does not exceed a wetted nozzle bubble pressure.

20. The method of claim 16, wherein the volume that is initially substantially void of a liquid has less than 15% of liquid.

21. The method of claim 16, wherein the volume that is initially substantially void of a liquid has less than 10% of liquid.

* * * * *